US008075291B2

(12) United States Patent
Lee et al.

(10) Patent No.: US 8,075,291 B2
(45) Date of Patent: Dec. 13, 2011

(54) SCROLL COMPRESSOR IMPROVED IN FUNCTION OF OIL CIRCULATION AND BACK PRESSURE CONTROL

(75) Inventors: Geonho Lee, Anseing-shi (KR); Dong-lim Nam, Yongin-si (KR); Young-chang Han, Jeonju-si (KR); Bo-Young Nam, Anseong-si (KR); Jung-Kyung Lee, Siheung-si (KR)

(73) Assignees: Doowon Technical College, Anseing-shi, Kyonggi-do (KR); Doowon Electronic Co., Ltd., Asan-shi, Chungnam (KR)

( * ) Notice: Subject to any disclaimer, the term of this patent is extended or adjusted under 35 U.S.C. 154(b) by 272 days.

(21) Appl. No.: 12/304,393

(22) PCT Filed: Jun. 13, 2007

(86) PCT No.: PCT/KR2007/002845

§ 371 (c)(1), (2), (4) Date: Mar. 5, 2009

(87) PCT Pub. No.: WO2007/145465

PCT Pub. Date: Dec. 21, 2007

(65) Prior Publication Data

US 2009/0191081 A1 Jul. 30, 2009

(30) Foreign Application Priority Data

Jun. 15, 2006 (KR) ..... 10-2006-0053798

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/55.5; 418/55.6; 418/57; 418/94; 418/270; 418/DIG. 1

(58) Field of Classification Search ..... 418/55.1–55.6, 418/57, 91, 94, 270, DIG. 1
See application file for complete search history.

(56) References Cited

U.S. PATENT DOCUMENTS 6,152,713 A * 11/2000 Hisanaga et al. ..... 418/55.6

FOREIGN PATENT DOCUMENTS

JP 62126282 A * 6/1987 ..... 418/55.6

(Continued)

OTHER PUBLICATIONS

International Search Report of PCT/KR2007/002845, dated Jul. 30, 2007.

*Primary Examiner* — Theresa Trieu
(74) *Attorney, Agent, or Firm* — Hamre, Schumann, Mueller & Larson, P.C.

(57) ABSTRACT

Provided is a scroll compressor having an improved function of oil circulation and back pressure control. The scroll compressor includes: a housing; a drive part for generating a rotational force; a drive shaft driven by the drive part; and a scroll compression part including a stationary scroll fixed regardless of rotation of the drive shaft and having a scroll wrap for compressing sucked fluid and a discharge port for supplying coolant into a discharge chamber, and an orbiting scroll orbited depending on rotation of the drive shaft and having a scroll wrap, characterized in that the coolant compressed by the scroll compression part is conveyed to the discharge chamber, the coolant of the discharge chamber is separated into oil and gas in an oil separator, the gas being discharged through a discharge hole and the oil being supplied into a back pressure chamber through a return path formed in the stationary scroll, and the oil is returned into a suction chamber through a back pressure adjustment valve.

7 Claims, 7 Drawing Sheets

FOREIGN PATENT DOCUMENTS

| | | | | | |
|---|---|---|---|---|---|
| JP | 64000382 | A | * | 1/1989 | ..... 418/55.6 |
| JP | 04143489 | A | * | 5/1992 | |
| JP | 06235387 | A | * | 8/1994 | ..... 418/55.6 |
| JP | 10-196562 | A | | 7/1998 | |
| JP | 2006-29185 | A | | 2/2006 | |
| JP | 2006-118511 | A | | 5/2006 | |
| KR | 10-1998-050613 | A | | 9/1998 | |
| KR | 10-0141079 | B1 | | 12/2003 | |
| KR | 10-2005-0073143 | A | | 7/2005 | |

* cited by examiner

[Fig. 1]
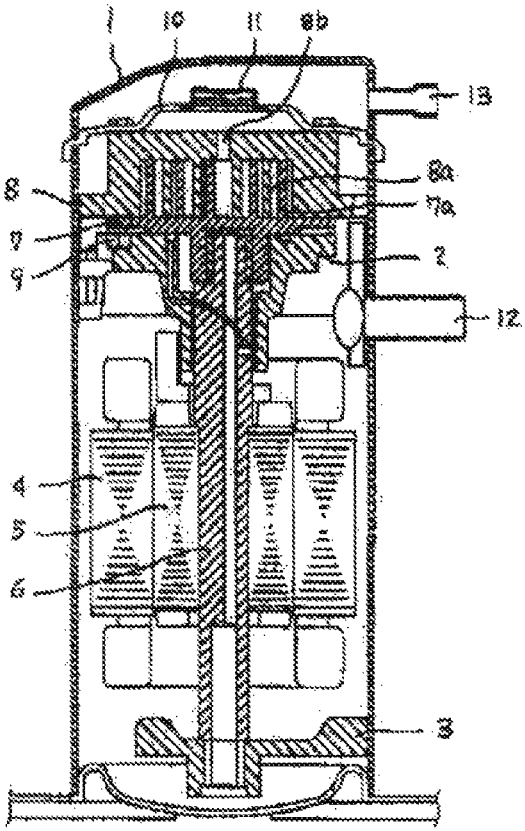
FIG 1-a
--PRIOR ART--
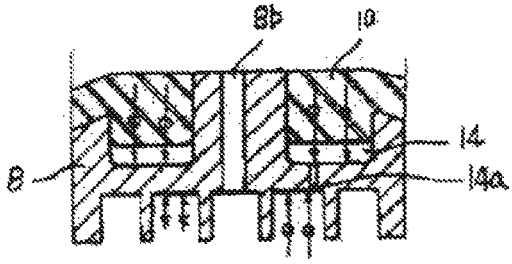
FIG 1-b
--PRIOR ART--

[Fig. 2]
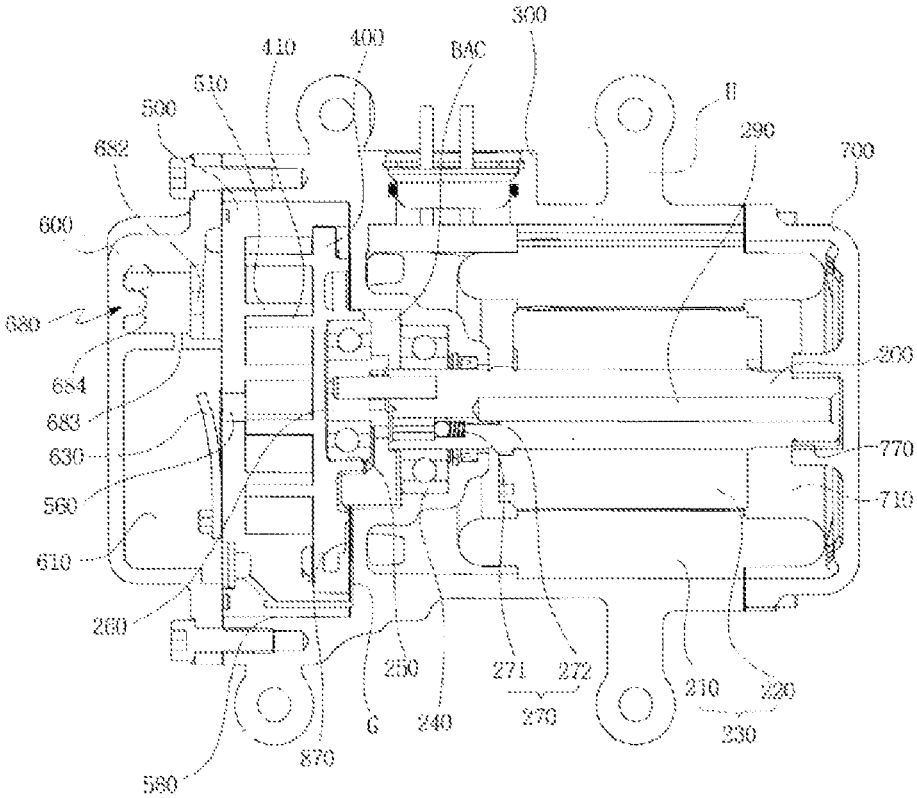
FIG 2-a
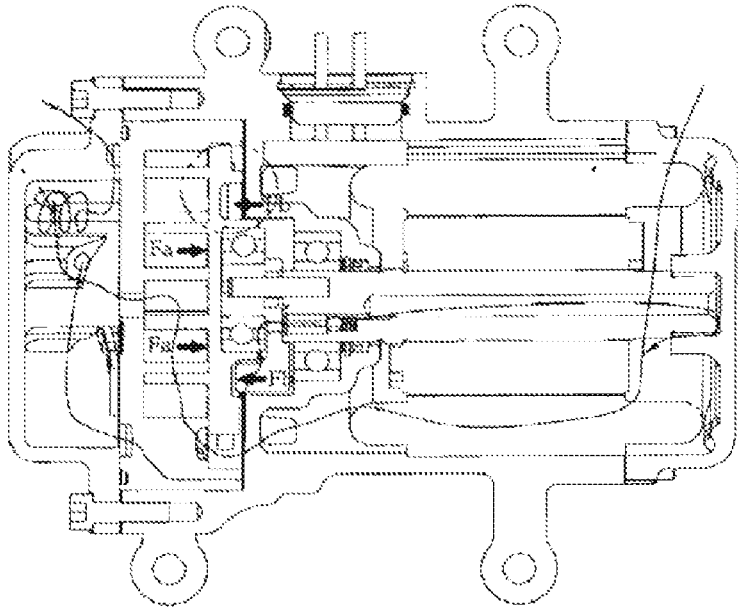
FIG 2-b

[Fig. 3]
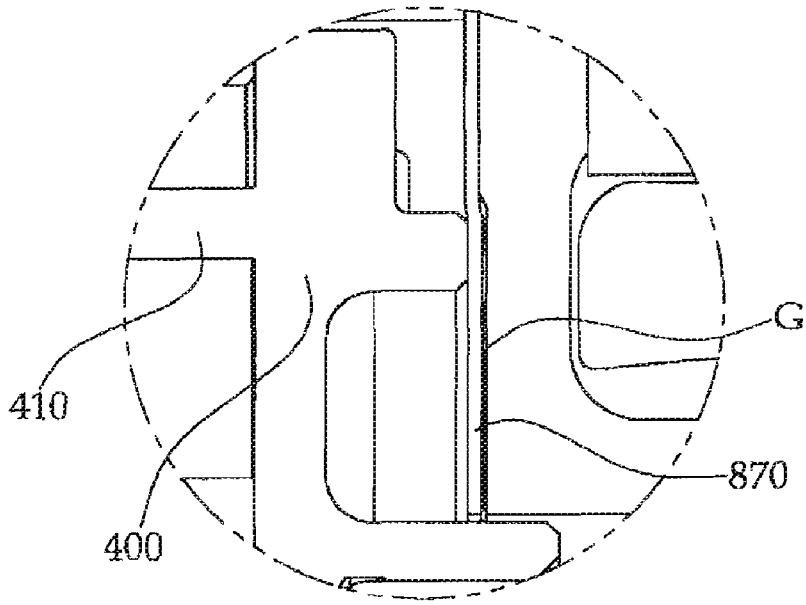
FIG 3-a
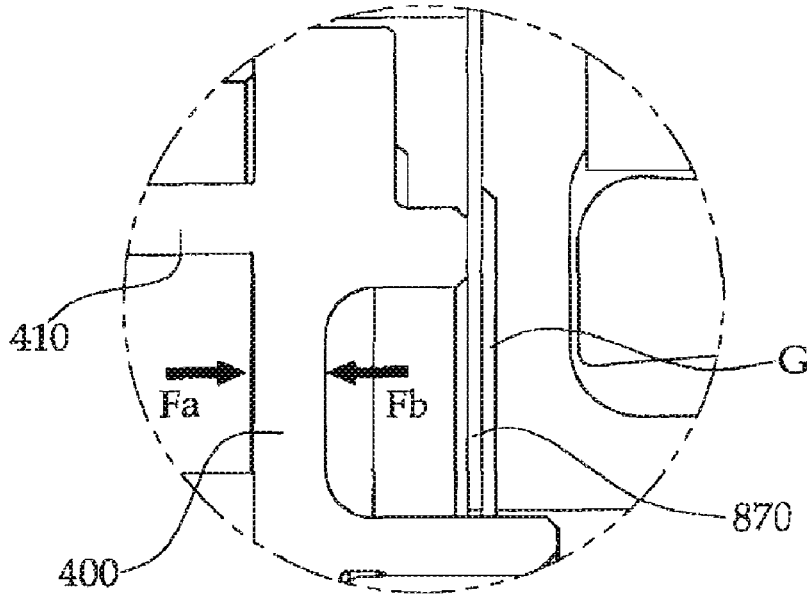
FIG 3-b

[Fig. 4]
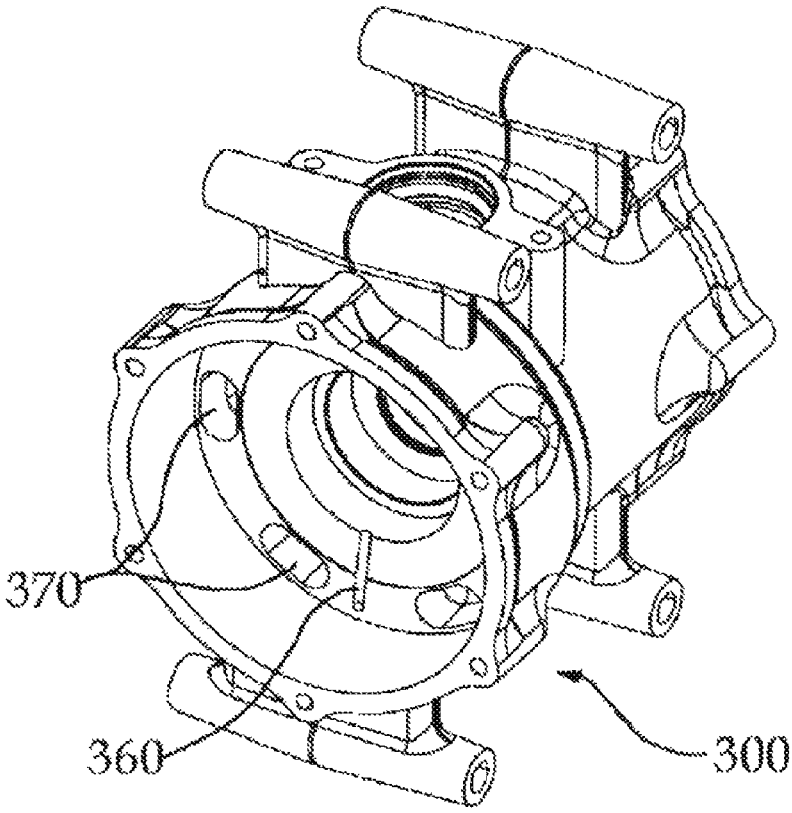
[Fig. 5]
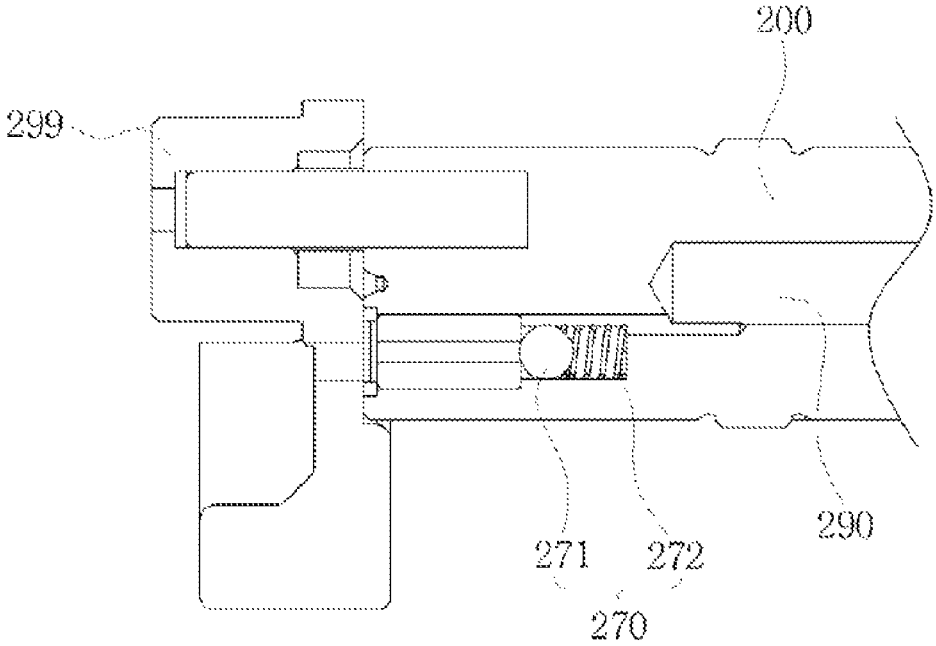

[Fig. 6]
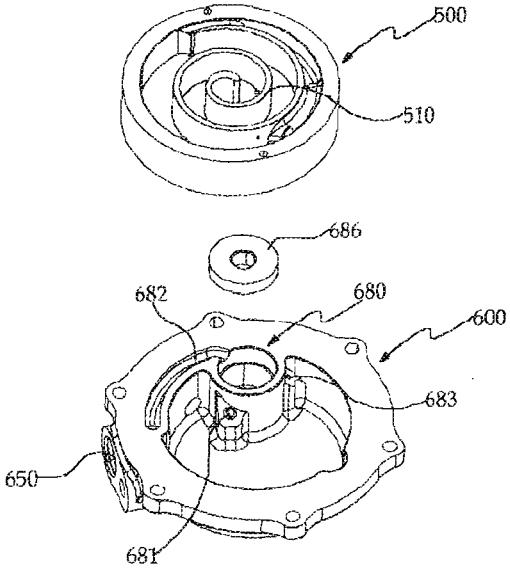
FIG 6-a
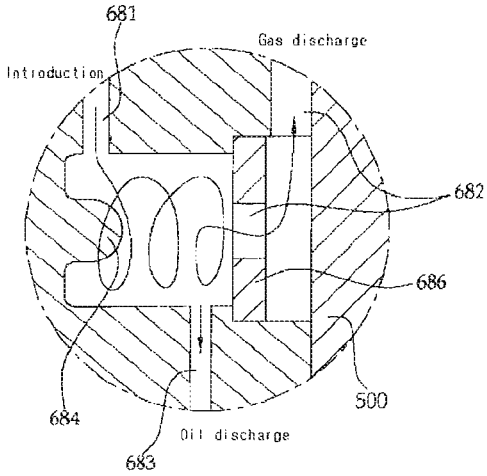
FIG 6-b
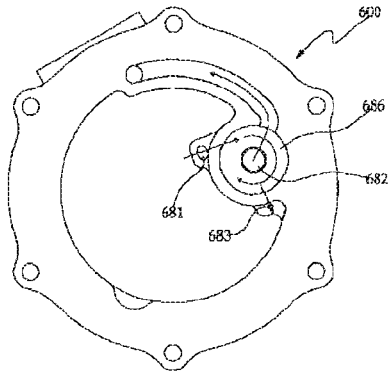
FIG 6- c

[Fig. 7]
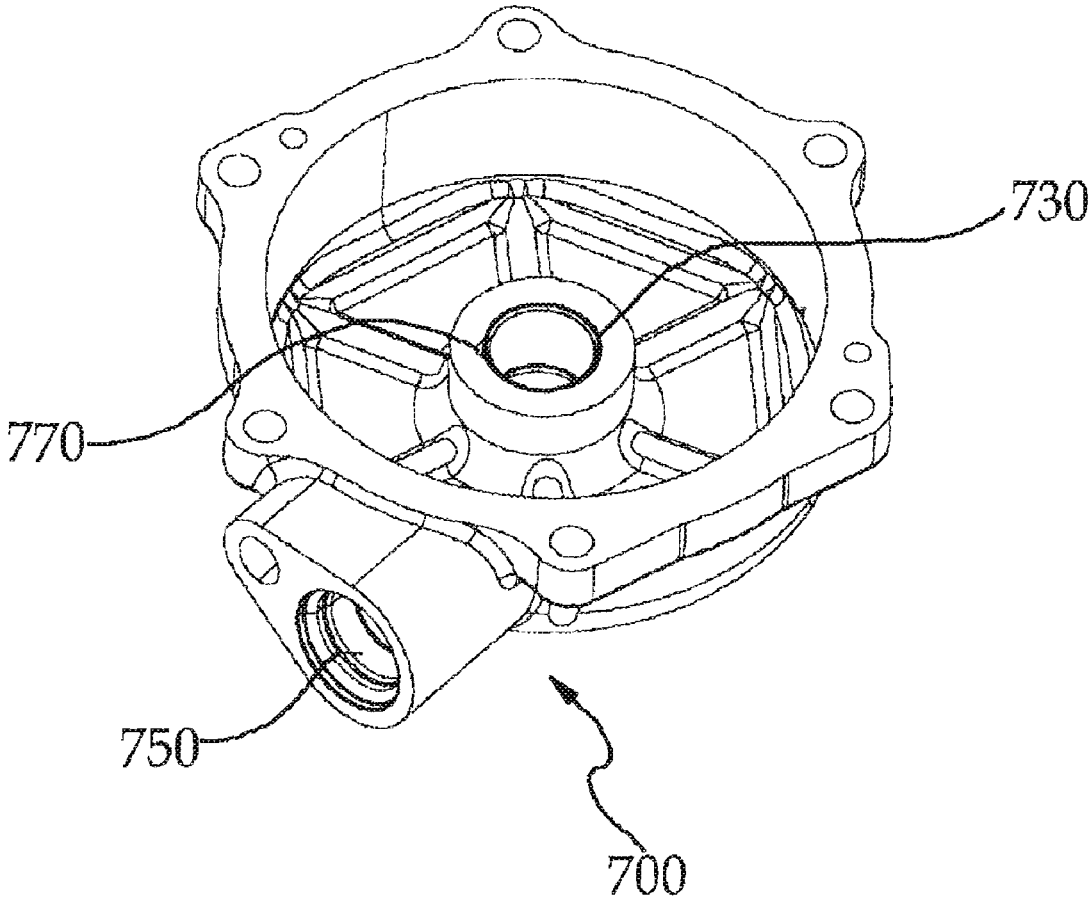

[Fig. 8]
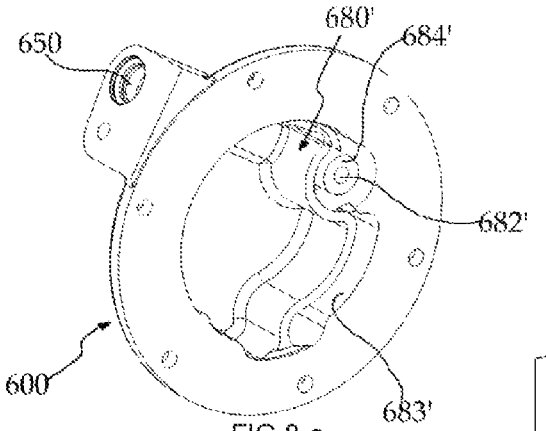
FIG 8-a
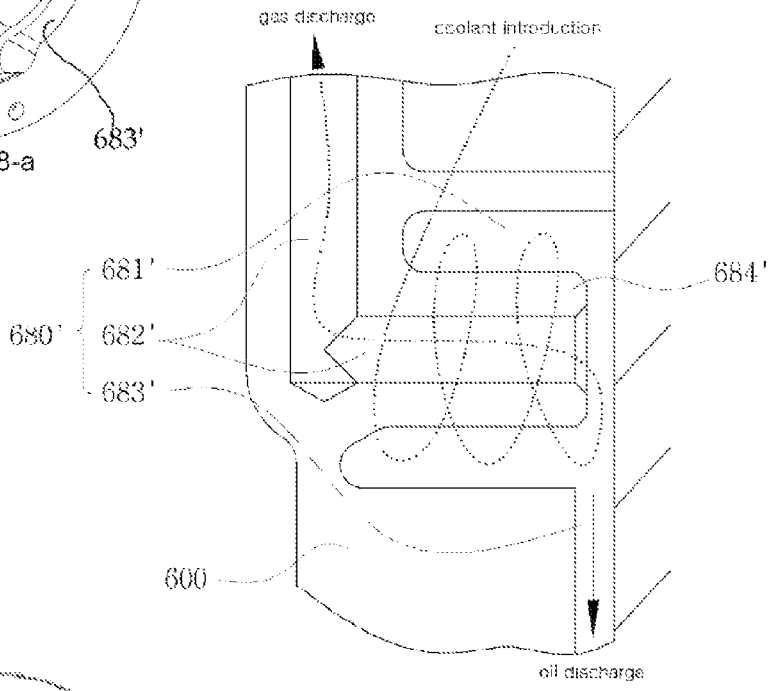
FIG 8-b
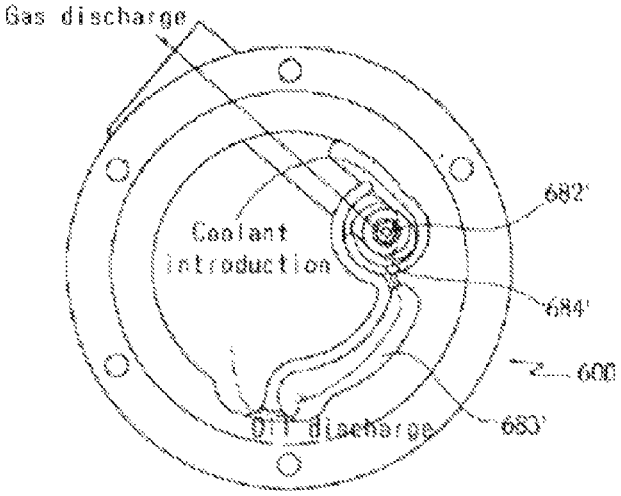
FIG 8-c

SCROLL COMPRESSOR IMPROVED IN FUNCTION OF OIL CIRCULATION AND BACK PRESSURE CONTROL

TECHNICAL FIELD

The present invention relates to a scroll compressor having an improved function of oil circulation and back pressure control, and more particularly, to a scroll compressor having an improved function of oil circulation and back pressure control capable of simultaneously performing the oil circulation and back pressure control.

BACKGROUND ART

A conventional scroll compressor is disclosed in Korean Patent Laid-open Publication No. 1998-50613, which will be described with reference to FIG. 1.

As shown, the conventional scroll compressor includes a sealing vessel 1, upper and lower frames 2 and 3 installed at upper and lower parts in the sealing vessel 1, a stator 4 fixedly installed between the upper and lower frames 2 and 3, a rotor 5 inserted into an inner periphery of the stator 4, a drive shaft 6 press fitted into a center of the rotor 5 to pass through a center of the upper frame 2, and an orbiting scroll 7 eccentrically coupled with the drive shaft 7 and having an involute curve wrap 7*a* formed at an upper end surface of the upper frame 2.

In addition, a stationary scroll 8 is disposed on the orbiting scroll 7 and fastened to a periphery of the upper frame 2 to be engaged with the orbiting scroll 7 to form a compression chamber, and an Oldham ring 9 as an anti-rotation member is installed between the upper frame 2 and the orbiting scroll 7.

In FIG. 1, reference numeral 10 designates a discharge cover, reference numeral 11 designates a check valve housing, reference numeral 12 designates a suction pipe, and reference numeral 13 designates a discharge pipe.

In the conventional scroll compressor, as power is applied, the rotor 5 is rotated inside the stator 4 to rotate the drive shaft 6, and the drive shaft 6 rotates the orbiting scroll 7 in an eccentric manner to a predetermined eccentric distance. At this time, the Oldham ring 9 forces the orbiting scroll 7 to perform an orbital movement about an axial center thereof at a distance spaced apart from an orbital radius.

The orbital movement of the orbiting scroll 7 forms a compression chamber (pocket) between the wraps 7*a* and 8*a* of the orbiting scroll 7 and the stationary scroll 8, and the compression chamber moves toward a center thereof by continuous orbital movement such that a volume of the compression chamber is reduced to further compress a coolant gas.

Here, as shown in FIG. 1A, an upper surface of the stationary scroll 8 and a lower surface of the discharge cover 10 have prominence and depression strictures to form a back pressure chamber 14 therebetween. A back pressure hole 14*a* is formed at one side of the back pressure chamber 14 to be in communication with the compression chamber of the stationary scroll 8, and sealing members (not shown) are disposed at both sides of the back pressure chamber 14.

In the conventional scroll compressor, a coolant gas introduced through a suction port (not shown) formed at the stationary scroll 8 is simultaneously sucked into both ends of a scroll circumference depending on an orbital movement of the orbiting scroll 7 to be trapped in two crescent-shaped pockets (or compression chambers) having the same volume. Then, the volumes of the pockets are continuously reduced to move their centers, thereby compressing the coolant gas.

Since the back pressure hole 14*a* is formed at a predetermined position of the stationary scroll 8 to be in communication with the back pressure chamber 14, an intermediate pressure of coolant gas enters the back pressure chamber 14 through the back pressure hole 14*a* to adhere the stationary scroll toward the orbiting scroll 7, thereby preventing the coolant gas from being leaked.

However, the coolant gas can only adjust a back pressure, and an apparatus for performing an oil circulation function such as lubrication still needs to be separately provided. As a result, the apparatus is complicated and its manufacturing process is very difficult.

In addition, since the stationary scroll is axially moved toward the orbiting scroll due to the back pressure, its structure is unstable and its vibration increases.

DISCLOSURE OF INVENTION

Technical Problem

In order to solve the problems, it is an object of the present invention to provide a scroll compressor having an improved function of oil circulation and back pressure control capable of readily performing lubrication of inner components and simultaneously maintaining a predetermined back pressure using an oil circulation structure.

It is another object of the present invention to provide a scroll compressor having an improved function of oil circulation and back pressure control capable of readily separating oil from coolant in the front of a housing.

It is still another object of the present invention to provide a scroll compressor having an improved function of oil circulation and back pressure control capable of securely maintaining axial sealing even when a back pressure varies.

Technical Solution

The foregoing and/or other objects of the present invention may be achieved by providing a scroll compressor having an improved function of oil circulation and back pressure control including: a housing; a drive part for generating a rotational force; a drive shaft driven by the drive part; and a scroll compression part including a stationary scroll fixed regardless of rotation of the drive shaft and having a scroll wrap for compressing sucked fluid and a discharge port for supplying coolant into a discharge chamber, and an orbiting scroll orbited depending on rotation of the drive shaft and having a scroll wrap, characterized in that the compressed coolant is conveyed to the discharge chamber, the coolant of the discharge chamber is separated into oil and gas in an oil separator, the gas being discharged through a discharge hole and the oil being supplied into a back pressure chamber through a return path formed in the stationary scroll, and the oil is returned into a suction chamber through a back pressure adjustment valve.

Here, the drive shaft may have a return fluid passage formed therethrough in its longitudinal direction.

The back pressure adjustment valve may be installed in the middle of the return fluid passage.

The back pressure adjustment valve may include a ball and a spring for resiliently supporting the ball.

In addition, an oil filter may be disposed in the return fluid passage.

Further, the oil separator may include a coolant introduction pipe formed in a cylindrical space in a tangential direction thereof, and a gas branch pipe and an oil branch pipe for discharging gas and oil separated from the introduced coolant, respectively.

Preferably, a guide projection may project from a bottom center of the cylindrical space.

In addition, a return path may be formed in a lower inner part of the stationary scroll, and a passage or a groove may be formed in the housing opposite to a thrust plate to flow oil therethrough.

Further, a gap may be formed between a rear part of the housing and a rear end of the drive shaft, and a discharge groove may be formed between the rear part of the housing and a rear outer surface of the drive shaft.

Furthermore, the thrust plate may be interposed between the orbiting scroll and an intermediate part of the housing, the gap may be formed between the thrust plate and the intermediate part of the housing, and the thrust plate may be deformed rearward by the orbiting scroll to narrow the gap when no load is applied.

BRIEF DESCRIPTION OF THE DRAWINGS

The above and other aspects and advantages of the present invention will become apparent and more readily appreciated from the following description of exemplary embodiments, taken in conjunction with the accompanying drawings, in which:

FIG. 1A is a longitudinal cross-sectional view of a conventional scroll compressor having a back pressure adjustment function;

FIG. 1B is a plan view showing a back pressure structure of FIG. 1;

FIG. 2 is a longitudinal cross-sectional view of a scroll compressor improved in oil circulation and back pressure control in accordance with an exemplary embodiment of the present invention;

FIG. 3 is an enlarged view showing an axial sealing structure of FIG. 2;

FIG. 4 is a perspective view showing an inner structure of an intermediate part of a housing of FIG. 2;

FIG. 5 is a longitudinal cross-sectional view showing a back pressure adjustment valve adjacent to a drive shaft of FIG. 2;

FIG. 6A is an exploded perspective view showing a coupling structure of a front part of the housing and a stationary scroll of FIG. 2;

FIG. 6B is an exploded perspective view of an oil separator of FIG. 6A, showing the principles of oil separation;

FIG. 6C is a front view of the front part of the housing of FIG. 2;

FIG. 7 is a perspective view showing a structure of a rear part of the housing of FIG. 2;

FIG. 8A is a perspective view showing a front part of a housing in accordance with another exemplary embodiment of the present invention;

FIG. 8B is an exploded perspective view of an oil separator of FIG. 8A, showing the principles of oil separation; and FIG. 8C is a front view of FIG. 8A.

BEST MODE FOR CARRYING OUT THE INVENTION

Reference will now be made in detail to exemplary embodiments of the present invention illustrated in the accompanying drawings.

As shown in the accompanying drawings, for example FIGS. 2 to 8*c*, a scroll compressor having an improved function of oil circulation and back pressure control in accordance with an exemplary embodiment of the present invention includes: a housing H; a drive part for generating a rotational force; a drive shaft 200 driven by the drive part; and a scroll compression part having a stationary scroll 500 fixed regardless of rotation of the drive shaft 200 and having a scroll wrap 510 for compressing sucked fluid, and an orbiting scroll 400 orbited depending on rotation of the drive shaft 200 and having a spiral scroll wrap 410.

Here, a discharge hole 650 and a discharge chamber 610 are formed at a front part 600 of the housing H, a passage through which coolant passes is formed at an intermediate part 300 of the housing H, and a suction hole 750 and a suction chamber 710 are formed at a rear part 700 of the housing H.

However, the suction hole, the suction chamber, the discharge hole, and the discharge chamber may be formed at arbitrary positions depending on necessity and convenience, without any limitation.

In addition, the drive part includes a drive motor 230 constituted of a stator 210 and a rotor 220 disposed inside the stator 210, and the drive shaft 200 inserted into the center of the drive motor 230 to be rotated therewith.

In addition, a main bearing 240 and a sub bearing 250 are installed in the front of the drive shaft 200 rotated by the drive motor 230. The sub bearing 250 supports an eccentric operation part 260 eccentrically installed with respect to the drive shaft 200.

A return path 290 is formed in the drive shaft 200 in its longitudinal direction to return oil from the discharge chamber 610 of the front part 600 of the housing H.

In particular, a back pressure adjustment valve 270 including a ball 271 and a spring 272 is installed at the return path 290 of the drive shaft 200. Therefore, the back pressure adjustment valve is opened to discharge the oil when a pressure in a back pressure chamber BAC is high, thereby uniformly maintaining the pressure.

The scroll compression part includes the stationary scroll 500 fixed to the front part 600 of the housing H and having a scroll wrap 510, and an orbiting scroll 400 coupled to the stationary scroll 500 and having a spiral scroll wrap 410.

The eccentric operation part 260 installed at the drive shaft 200 is connected to the orbiting scroll 400 through the medium of the sub bearing 250.

Therefore, as the drive shaft 200 rotates, the eccentric operation part 260 is eccentrically rotated with respect to the drive shaft 200. As a result, the orbiting scroll 400 installed at the eccentric operation part 260 through the medium of the sub bearing 250 is orbited with respect to the stationary scroll 500.

As described above, a pocket is formed between the scroll wraps 410 and 510 depending on orbital movement of the orbiting scroll 400, and its volume is continuously varied to compress coolant.

Meanwhile, as shown in FIG. 7, a bearing 730 is installed between the rear part 700 of the housing H and the drive shaft 200, and an axial groove 770 is formed at a bearing installation surface of the rear part 700 of the housing H to flow oil returned between the bearing 730 and the bearing installation surface.

Of course, the oil discharged through the axial groove 770 is introduced into the suction chamber 710. Then, the introduced coolant is moved to the scroll compression part through a plurality of through-holes 370 (in this embodiment, six) formed at the intermediate part 300 of the housing H.

As shown in FIG. 6, the discharge chamber 610 is formed inside the front part 600 of the housing H, and the discharge hole 650 is formed at one side of an outer periphery thereof to be in communication with the discharge chamber 610.

In addition an oil separator 680 is formed at the front part 600 of the housing 11 to separate the coolant introduced into the discharge chamber 610 into oil and gas.

The oil separator 680 has a substantially cylindrical space, and includes a coolant introduction pipe 681 formed in the space in a tangential direction thereof, and a gas branch pipe 682 and an oil branch pipe 683 through which the introduced coolant is separated into gas and oil and discharged. Therefore, the tangentially introduced coolant is rotated in the oil separator 680 to be smoothly separated into the oil and gas using the principles of centrifugal separation, and then discharged.

In particular, a guide projection 684 may be formed at a bottom center of the cylindrical space to increase the centrifugal separation effect. In addition, an opening is in contact with the stationary scroll 500 to be closed. Therefore, the gas is discharged through a path formed between the gas branch pipe 682 and the stationary scroll 500.

In addition, as shown in FIG. 2, a discharge port 560 is formed at a center of the stationary scroll 500 to transfer the compressed coolant to the discharge chamber 650 of the front part 600 of the housing H.

Further, the return path 580 is formed in the stationary scroll 500 deviated from a center of the drive shaft 200.

A check valve 630 may be installed at the discharge port 560 to prevent back flow of the discharged coolant.

As shown in FIG. 3, an elastic thrust plate 870 is interposed between the orbiting scroll 400 and an inner end of the intermediate part 300 of the housing 14 to support orbital movement of the orbiting scroll 400.

In particular, when there is no load, the thrust plate 870 is previously deformed to approach the intermediate part 300 of the housing H and maintain the approached state. That is, a gap G between the thrust plate 870 and the intermediate part 300 is kept narrow. When a high back pressure is applied, the orbiting scroll 400 moves forward somewhat to be spaced apart from the intermediate part 300 of the housing H. However, since the spaced distance merely corresponds to an extent that the deformed thrust plate 870 is slightly released, the sealing is securely maintained in any case.

In addition, a radial flow groove 360 is formed at a front surface of the intermediate part 300 of the housing H opposite to the thrust plate 870 to flow the returned oil toward the back pressure chamber BAC.

Hereinafter, an oil circulation operation will be described with reference to the above constitution.

First, coolant in which oil and gas are mixed with each other is introduced through the suction hole 750 and passes between the spiral scroll wraps 410 and 510 of the orbiting scroll 400 and the stationary scroll 500. In addition, the coolant passes through the scroll compression part and is compressed, and is then introduced into the discharge chamber 610 through the discharge port 560 of the stationary scroll 500.

The coolant introduced into the discharge chamber 610 enters the oil separator 680 to be divided into oil and gas using the principles of centrifugal separation. The gas is discharged through the discharge hole 650, and the oil moves downward through the return path 580 formed at the stationary scroll 500.

The oil passed through the return path 580 moves to the back pressure chamber BAC through the radial groove 360 formed inside the housing H opposite to the thrust plate.

In addition, the oil introduced into the back pressure chamber BAC passes through the sub bearing 250 to perform lubrication, and is then continuously introduced into the return path 290 of the drive shaft 200. At this time, when the back pressure is lower than a reference value, the back pressure adjustment valve 270 is not opened, and when the back pressure is higher than the reference value, the back pressure adjustment valve 270 is opened such that the oil perfectly passes through the return path 290 of the drive shaft 200.

The oil passed through the return path 290 is returned to the suction chamber 710 through the axial groove (not shown) formed inside the rear part of the housing H. Then, the oil is mixed with newly introduced oil to enter the scroll compression part.

In FIG. 2, a load Fb applied to the orbiting scroll 400 by the back pressure and an opposing force Fa against the stationary scroll 500 are shown.

Meanwhile, an oil separator 680' formed at the front part 600 of the housing H may have the constitution shown in FIG. 8, in addition to the constitution of FIG. 6.

Specifically, the oil separator 680' has a substantially cylindrical space having a gap 681' opened at one side thereof, and includes a gas branch pipe 682' and an oil branch pipe 683' through which the introduced coolant is separated into gas and oil and discharged.

Here, the gas branch pipe 682' is in communication with the discharge hole 650 of the front part 600 of the housing H from a hole longitudinally passing through a guide projection 684' formed at a bottom center of the cylindrical space.

In addition, the oil branch pipe 683' is opposite to a front surface of the stationary scroll 500 to form a oil discharge path.

Meanwhile, when seen from an axial direction, the gap 681' is formed at the oil separator 680' in a tangential direction. Therefore, in the oil separator 680', the tangentially introduced coolant is rotated to be smoothly separated into oil and gas and then discharged using the principles of centrifugal separation.

In particular, the centrifugal separation effect may be greatly increased by the guide projection 684' projecting from a bottom center of the cylindrical space.

As a result, as shown in FIG. 81X, the coolant introduced into the oil separator 680' through the opened gap 681' is rotated around the guide projection 684' to be smoothly separated into oil and gas using the principles of centrifugal separation. In addition, the separated oil is discharged through the oil branch pipe 683' to return to the suction chamber 710, and the gas moves through the gas branch pipe 682' to be continuously discharged through the discharge hole 650.

INDUSTRIAL APPLICABILITY

As can be seen from the foregoing, since coolant is separated into oil and gas through an oil separator and then the separated oil is re-circulated, it is possible to readily lubricate inner components and uniformly maintain a back pressure.

In particularly, since the oil separator uses the principles of centrifugal separation and a guide projection is formed to increase the centrifugal separation effect, it is possible to effectively separate oil and gas from the coolant.

In addition, since a thrust plate opposite to an intermediate part of a housing is previously deformed rearward and installed in the deformed state, although a pressure in the back pressure chamber is increased, it is possible to securely prevent axial leakage of oil due to forward movement of an orbiting scroll.

Further, since lubrication can be smoothly performed, an inexpensive bearing such as a bush bearing can be used to reduce the total manufacturing cost.

The invention claimed is:

1. A scroll compressor having an improved function of oil circulation and back pressure control, comprising:

a housing;

a drive part for generating a rotational force;

a drive shaft driven by the drive part; and a scroll compression part including a stationary scroll fixed regardless of rotation of the drive shaft and having a scroll wrap for compressing sucked fluid and a discharge port for supplying coolant into a discharge chamber, and an orbiting scroll orbited depending on rotation of the drive shaft and having a scroll wrap, characterized in that the coolant compressed by the scroll compression part is conveyed to the discharge chamber, the coolant of the discharge chamber is separated into oil and gas in an oil separator, the gas being discharged through a discharge hole and the oil being supplied into a back pressure chamber through a return path formed in the stationary scroll, and the oil is returned into a suction chamber through a back pressure adjustment valve, wherein the drive shaft has a return fluid passage formed therethrough in its longitudinal direction, the back pressure adjustment valve being installed in the return fluid passage to control the back pressure of the oil introduced into the back pressure chamber (BAC) so that the oil flows into the suction chamber via the return fluid passage.

2. The scroll compressor according to claim 1, wherein the back pressure adjustment valve is installed in the middle of the return fluid passage.

3. The scroll compressor according to claim 1, wherein the back pressure adjustment valve comprises a ball and a spring for resiliently supporting the ball.

4. A scroll compressor having an improved function of oil circulation and back pressure control, comprising:

a housing;

a drive part for generating a rotational force;

a drive shaft driven by the drive part; and a scroll compression part including a stationary scroll fixed regardless of rotation of the drive shaft and having a scroll wrap for compressing sucked fluid and a discharge port for supplying coolant into a discharge chamber, and an orbiting scroll orbited depending on rotation of the drive shaft and having a scroll wrap, characterized in that the coolant compressed by the scroll compression part is conveyed to the discharge chamber, the coolant of the discharge chamber is separated into oil and gas in an oil separator, the gas being discharged through a discharge hole and the oil being supplied into a back pressure chamber through a return path formed in the stationary scroll, and the oil is returned into a suction chamber through a back pressure adjustment valve, wherein the oil separator comprises a coolant introduction pipe formed in a cylindrical space in a tangential direction thereof, and a gas branch pipe and an oil branch pipe for discharging the gas and oil separated from the introduced coolant, respectively, wherein the drive shaft has a return fluid passage formed therethrough in its longitudinal direction, the back pressure adjustment valve being installed in the return fluid passage to control the back pressure of the oil introduced into the back pressure chamber (BAC) so that the oil flows into the suction chamber via the return fluid passage.

5. The scroll compressor according to claim 4, wherein a guide projection projects from a bottom center of the cylindrical space.

6. The scroll compressor according to claim 4, wherein a return path is formed in a lower inner part of the stationary scroll, a thrust plate is interposed between the orbiting scroll and an intermediate part of the housing, and a passage or a groove is formed in the housing opposite to the thrust plate to flow oil therethrough.

7. A scroll compressor having an improved function of oil circulation and back pressure control, comprising:

a housing;

a drive part for generating a rotational force;

a drive shaft driven by the drive part; and a scroll compression part including a stationary scroll fixed regardless of rotation of the drive shaft and having a scroll wrap for compressing sucked fluid and a discharge port for supplying coolant into a discharge chamber, and an orbiting scroll orbited depending on rotation of the drive shaft and having a scroll wrap, characterized in that the coolant compressed by the scroll compression part is conveyed to the discharge chamber, the coolant from the discharge chamber is separated into oil and gas in an oil separator, the gas being discharged through a discharge hole and the oil being supplied into a back pressure chamber through a return path formed in the stationary scroll, and the oil is returned into a suction chamber through a back pressure adjustment valve, wherein a thrust plate is interposed between the orbiting scroll and an intermediate part of the housing, a gap is formed between the thrust plate and the intermediate part of the housing, and the thrust plate is deformed rearward by the orbiting scroll to narrow the gap when no back pressure is applied, wherein the drive shaft has a return fluid passage formed therethrough in its longitudinal direction, the back pressure adjustment valve being installed in the return fluid passage to control the back pressure of the oil introduced into the back pressure chamber (BAC) so that the oil flows into the suction chamber via the return fluid passage.

* * * * *